United States Patent [19]

Middlekauff

[11] Patent Number: 4,586,885

[45] Date of Patent: May 6, 1986

[54] COMPACT HIGH TORQUE HYDRAULIC MOTORS

[75] Inventor: Carle A. Middlekauff, Cumberland, Me.

[73] Assignee: Parker-Hannifin Corporation, Cleveland, Ohio

[21] Appl. No.: 679,315

[22] Filed: Dec. 7, 1984

Related U.S. Application Data

[63] Continuation of Ser. No. 473,367, Mar. 8, 1983, Pat. No. 4,501,536.

[51] Int. Cl.[4] ..... F03C 2/00

[52] U.S. Cl. ..... 418/61 B

[58] Field of Search ..... 418/60, 61 R, 61 B

[56] References Cited

U.S. PATENT DOCUMENTS 3,453,966 7/1969 Eddy ..... 418/61 B 4,264,288 4/1981 Wusthoff et al. ..... 418/61 B 4,411,607 10/1983 Wusthoff et al. ..... 418/61 B

*Primary Examiner*—John J. Vrablik

*Attorney, Agent, or Firm*—Hamilton, Brook, Smith & Reynolds

[57] ABSTRACT

A compact hydraulic motor 10 in which a pressurized sleeve bearing 20 is coaxial with a commutator 16, all positioned in the output housing 14. The commutator housing provides fluids to a rotary valve plate 48 and to chambers 52 formed between rotating inner member 30 and orbiting outer member 32. The sleeve bearing 20 is pressurized with fluid from the gear set 30, 32 and is in fluid communication with a rear needle bearing 24. The seals are protected from overpressurization through channels 25 and 46 and pressurization valves. In an alternate embodiment of the invention, dual gear sets 80, 82, and 81, 83, (FIG. 7) are positioned within a housing for either series or parallel operation. Fluid directed to the two gear sets by a manifold 112 can run the gear sets in parallel or series in order to provide either high speed low torque or low speed high torque operation.

2 Claims, 9 Drawing Figures

COMPACT HIGH TORQUE HYDRAULIC MOTORS

This application is a continuation of application Ser. No. 473,367, filed 3/8/83 now U.S. Pat. No. 4,501,536.

DESCRIPTION

1. Technical Field

This invention relates to compact hydraulic motors, particularly those incorporated into machinery which requires high motor torque in a limited space.

2. Background

The commonly used form of hydraulic motor consists of internal gear or gerotor sets in which inner and outer gear members have radially projecting teeth that engage with each other to form expanding and contacting chambers. Pressurized fluid circulated through the chambers produces shaft rotation. Conversely, in a pump, shaft rotation is used to produce fluid pressure. Thus, these gear sets can be used as either hydraulic motors or hydraulic pumps.

In a common gear or gerotor type motor, an inner gear is made to rotate eccentrically within a housing enclosing an outer member, the outer periphery of the inner gear member is contoured or shaped for reciprocal contact with the outer gear member. This relationship between the inner gear and outer member forms the expanding and contracting chambers. The eccentric rotational movement of the inner member is transmitted through a sleeve coupling called a "dogbone" to a centrally rotating shaft from which machinery movement is powered. A gerotor motor with "dogbone" coupling can be seen, for example, in U.S. Pat. No. 3,549,284. The "dogbone" coupling is required to correct eccentric rotation to concentric central shaft rotation to produce useful work.

An alternative to the "dogbone" coupling is a shaft motor in which the central axis is fixed and an orbiting outer member moves eccentrically about an inner member which rotates about a fixed axis. See, for example, U.S. Pat. No. 2,989,951. The creation of a fixed axis, or through shaft, is generally accomplished by allowing the outer member of the gerotor set to orbit about the center of rotation of the inner member's fixed axis. This motion is a type of circular shuttle motion in which the entire outer member moves in a circle at a small radial distance from the inner member's axis. This radial distance is the eccentricity required for the motor to operate by forming expanding and contracting chambers of varying size between the inner and outer members.

The present invention relates to improvements in through shaft hydraulic motors. Such hydraulic motors are frequently too large to operate efficiently in small machinery. A reduction of axial length would greatly aid incorporation of these motors into small machines. Conventional hydraulic motors with central shafts require the positioning of a bearing between the output shaft and the rotating gear set to support even moderate loads. Since the output shaft must be able to support the full torque capability of the motor, shaft diameter should not be measurably reduced between the output shaft and the central gear set. The bearing placed around the shaft expands the envelope that the shaft requires within the housing. This expanded envelope effectively blocks fluid access to the gear set adjacent to the output bearing. In hydraulic motors it has therefore been necessary to place the commutator and valve that supply and withdraw hydraulic fluid from the gerotor set at the opposite end of the motor from the output shaft. The total motor length is therefore increased in accordance with motor capacity.

Another problem found in hydraulic motors is the need for expensive variable pump systems to vary motor torque and speed. An example of this problem is found where winches are used for either industrial or maritime service. When a winch is carrying an object under load, high torque and low speed is desired to carefully position the object. After the object has been released and the winch is unloaded, high speed is desired so that the winch may be quickly returned to its starting position and the next object can be loaded. Conventional hydraulic winch motors require a variable pump or transmission to accomplish this. Variable pumps and transmissions are expensive. Additionally, conventional motors require a high fluid flow rate for high speed use. In such a system, a fixed displacement pump and motor would not be adequate since they produce only one speed and torque.

A need therefore exists for a compact inexpensive through shaft motor which may be arranged for multi-speed operation.

SUMMARY OF THE INVENTION

The invention comprises a compact hydraulic motor having a housing with inlet and outlet ports for the entry and exit of hydraulic fluid, and a shaft for rotation about a longitudinal axis. The shaft has an output end extending from the housing and supported by bearings within the housing. One of the bearings is located adjacent to the shaft's primary output end and is a sleeve bearing. The sleeve bearing is adapted to be pressurized during the operation of the motor. Another bearing is a full complement needle bearing.

The apparatus further comprises an inner member mounted for central rotation upon the longitudinal fixed axis of the shaft positioned between the bearings. Also enclosed within the housing is an outer member mounted for eccentric nonrotational orbital movement with respect to the fixed axis. The outer member defines with the inner member a plurality of circumferentially spaced chambers. The volume of the individual chambers varies with rotation of the inner member.

A commutator is positioned coaxially with said sleeve bearing in order to direct fluid from the inlet and outlet ports to the chambers formed by the inner and outer members. A rotatable valve controls the flow from the commutator to the chambers in a manner which causes rotation of the inner member when pressurized fluid is supplied to the motor.

In a preferred embodiment of the invention, the sleeve bearing is a TEFLON coated DU bearing. A DU bearing is a sleeve bearing formed of steel backed porous bronze impregnated with TEFLON. Further, the preferred apparatus comprises a pressurization system for maintaining fluid pressure in the sleeve bearing. The full complement needle bearing acts to pressurize fluid released from the gear set in order to pressurize the DU bearing.

In a further embodiment of the invention, fluid passages comprise clearances spaces between the shaft, valve plate, and inner member which are positioned to allow the sleeve bearing to receive fluid from the gear set and needle bearing.

In another embodiment of the invention, the motor housing has two inlet and outlet ports for the entry and exit of fluid. Two gear sets are enclosed within the housing and comprise two inner members mounted upon the shaft for rotation about the fixed longitudinal axis. The inner members have a plurality of circumferentially spaced teeth. Two outer members are mounted within the housing for eccentric nonrotational movement in respect to the fixed axis of the shaft. The outer members have multiple arcuate teeth on their inner peripheral surface and the teeth are one greater in number than the number of teeth on the inner member. These teeth have a continuously changing radius of curvature in order to provide for continuous reciprocal interaction with the teeth of the inner member. In that way, they define with the inner members a plurality of circumferentially spaced chambers.

Valve means is mounted for rotation about the longitudinal axis in order to provide fluid communication between the inlet and outlet ports and the chambers formed between the inner and outer members. This fluid communication results in the rotation of the inner members in the shaft.

This embodiment also comprises an external manifold means for controlling the input and output flow to the gear sets. The manifold means controls the flow so that the gear sets may be operated in either a series or parallel mode.

In the preferred embodiment of the invention, wherein the motor comprises two gear sets, bearings adjacent to each gear set support the central shaft. One of the bearings is a pressurized sleeve bearing. Further elements of the preferred embodiment comprise stationary commutators coaxial with the bearings to conduct fluid from the inlet and outlet ports to multiple inlet and outlet commutator ports adjacent to the valve means. One of the commutators is positioned adjacent to the shaft's primary output end and one of the commutators is positioned adjacent the shaft's secondary end. Each commutator has a number of input commutator ports equal to the number of teeth on each of the outer members and a number of input commutator ports equal to the number of teeth on each said outer members.

Another aspect of the preferred embodiment wherein the motor comprises two gear sets, is a pressurization valve for maintaining fluid pressure in the bearings and passages positioned between the inner members and the bearings to allow for the bearings to receive fluid from the gear sets.

BRIEF DESCRIPTION OF THE DRAWINGS

The foregoing and other objects and advantages of the invention will be apparent from the following more particular description of the preferred embodiments of the invention, as illustrated in the accompany drawings, in which like reference characters refer to the same parts throughout the different views. The drawings are not necessarily to scale, emphasis instead being placed upon illustrating the principles of the invention.

DETAILED DESCRIPTION OF THE INVENTION

Figure 1:
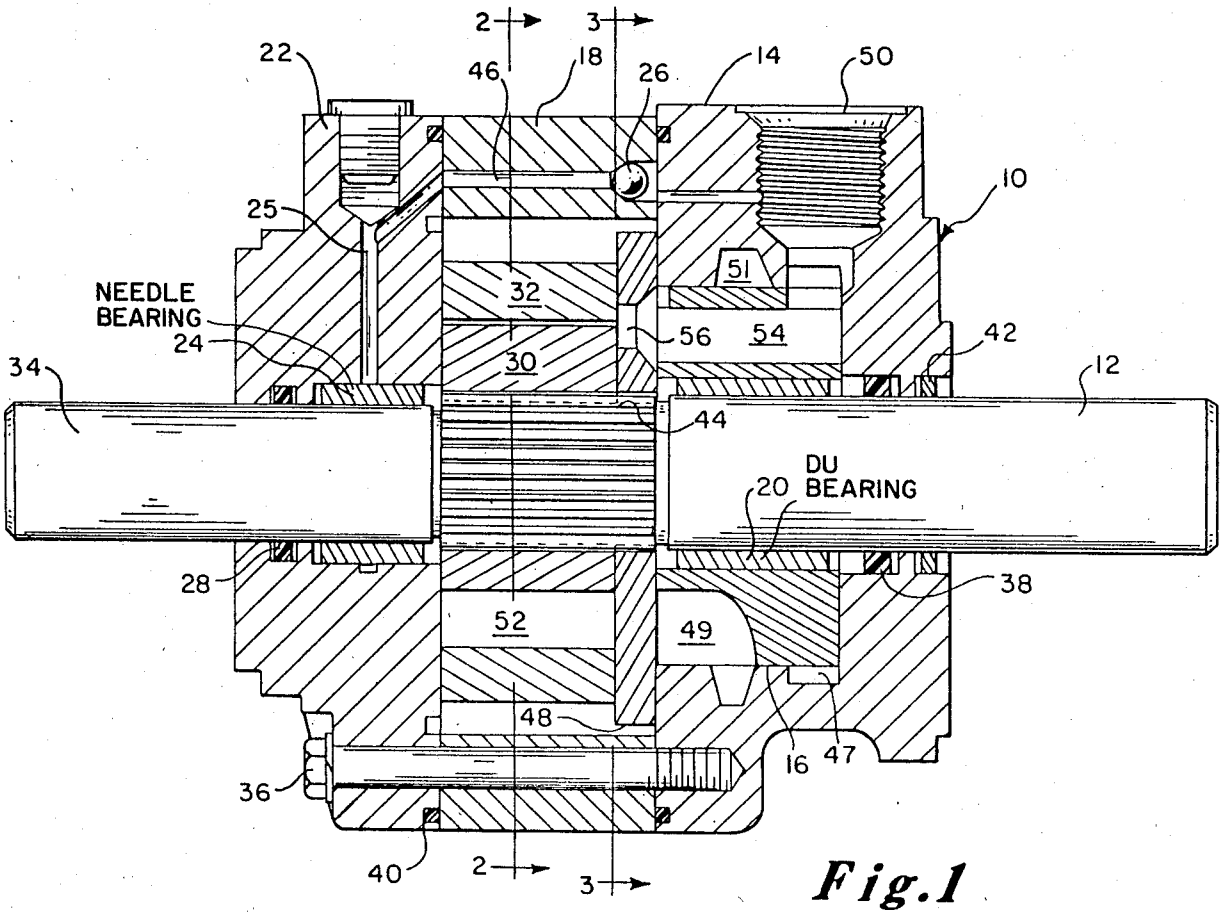
FIG. 1 is a cross section of a first embodiment of the invention disclosing a compact high torque hydraulic motor.

FIG. 1 is an axial cross section of a compact single displacement high torque low speed motor. This motor makes use of a teflon coated sleeve bearing to allow for a commutation and valving arrangement that reduces motor size and weight.

The motor 10 is made up of three casings in which a central shaft 12 rotates. The output shaft casing 14 houses a pressurized sleeve, or DU, bearing 20 which supports shaft 12 and allows for the placement of commutator 16 within the casing 14.

The gear set 30, 32 is maintained within a gear set housing 18. A valve plate 48 and the inner gear 30 are affixed to the shaft 12 for rotation. The outer gear 32 is restricted from rotation by housing 18.

Rear housing 22 contains the rear section of the shaft 12 and a conventional roller bearing 24. Since the commutator 16 is coaxial with the sleeve, or DU, bearing 20 in the forward housing 14, the aft housing 22 may be minimized without affecting motor capability.

The aft needle, or roller, bearing 24 acts to pressurize hydraulic fluid for lubrication of the sleeve bearing. Overpressurization is prevented through the use of ball valve 26 found in gear set housing 18. The ball valve 26 allows fluid passage from lines 46 and 25 into port 50, when the pressure in the lines is higher than that at input port 50. A similar valve arrangement also connects these lines with a similar output port (not shown).

The optional rear shaft 34 may be used for either a speed sensor or brake. It should be noted that the rear shaft is of a smaller diameter than the output shaft and therefore incapable of supporting the full load of the hydraulic motor.

Access to internal components is achieved by removal of bolts 36. Removal of bolts allows all components to be disassembled. Between each component are seals 40 which prevent hydraulic fluid leakage from the motor. Seal 38 prevents fluid leakage forward of sleeve bearing 20 and seal 28 prevents fluid leakage aft of needle bearing 24. The seals are maintained in position by a close tolerance fit and internal motor pressure during motor operation. Dust cover 42 prevents foreign matter from entering into the internal workings of the motor.

The output shaft housing 12 incorporates some of the principles of the invention and in that respect is substantially different from conventional housings. A DU bearing 20 is positioned about central shaft 12. Passage of hydraulic fluid to the bearing is allowed through passages 44 (FIGS. 1 and 2) from the valve 48 and gear set 30, 32. The sleeve bearing is configured to draw hydraulic fluid into itself during operation of the motor.

Fluid leakage across the face of the gear set 30, 32 and valve 48, allows hydraulic fluid to reach the passages 44. The passages are formed between the teeth of the splined shaft 12 and the roots of the inner gear 30, and between the teeth of the shaft and the valve plate 48. The passages 44 permit fluid communication between bearing 24 and bearing 20. Bearing 24 is a full complement needle bearing in which there is only an extremely small gap between the needles. The bearing 24 acts as a flow restriction, or valve, which serves to pressurize the fluid in passages 44 and thereby pressurize the sleeve bearing 20. During motor operation, bearing pressurization fluctuates between 50 and 200 psi but generally remains at about 100 psi.

Ball valve 26 to input port 50 or the similar ball valve to the output port serves to prevent overpressurization of the seals. The needle bearing 24 feeds line 25 through the bearing needles and thereby restricts flow. Fluid flows through passages 25 and 46 to the port of lower pressure when seal pressure is excessive, thereby relieving excess pressurization. This prevents cavitation of the sleeve bearing 20 during sudden shifts in motor speed or motor reversal. Cavitation of the sleeve bearing would cause damage to the bearing that would result in bearing failure in a very short time.

Use of the DU bearing allows for the positioning of commutator 16 at the correct radial location to feed the gear set 30, 32. The thin cross section of the DU bearing allows the commutator 16 to be small enough to fit into housing 14 in a manner which allows it to feed fluid through the valve plate to the gear set, efficiently.

Motor load is for the most part accommodated by forward bearing 20, therefore aft bearing 24 may need only support the shaft 12 and accommodate gear set load. For these reasons, bearing size can be safely reduced. The lack of commutator and fluid flow passages allows for a reduction of the aft housing's 22 axial length and weight as compared to conventional motor housings.

Since commutator 16 may be efficiently positioned forward of gear set 30, 32, the motor is considerably shorter axially than would otherwise be the case. The commutator 16 occupies the same axial location as the forward bearing 20, and there is no increase in size of the forward housing 11. This results in a considerable size reduction from a conventional high torque hydraulic motor. Since housing 14 is no longer axially than those in conventional motors and is capable of comparable loads, the motor as a whole is lighter and therefore more efficient for uses where weight is a consideration. The one inch shaft of this compact motor is capable of handling 1,500 pounds of radial load in spite of a minimum motor length of about only four inches.

During motor operation, high pressure fluid enters the hydraulic motor through inlet port 50 (FIG. 1). At the base of the inlet port 50 is inlet gallery 47 which serves to conduct fluid to eight inlet commutator ports 54 in the commutator 16. The inlet gallery or plenum 47 is an open annulus in the commutator connecting all the high pressure ports 54 of the commutator and equalizing fluid pressure amongst them.

High pressure flows through the valve plate 48 which is affixed to shaft 12 and rotates with it. Valve plate 48 has a plurality of fluid transmission ports 56.

Figure 3:
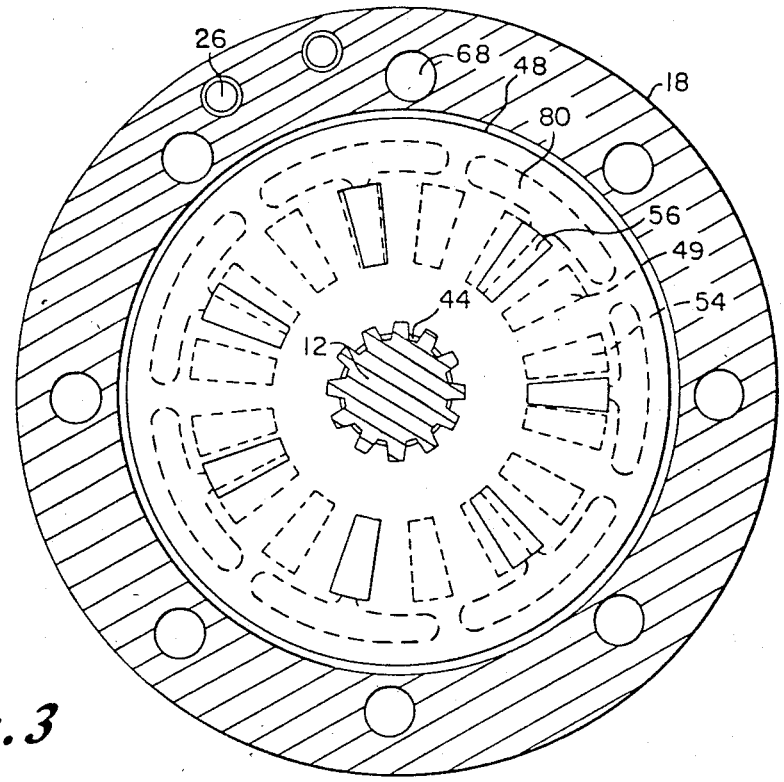
FIG. 3 is a cross section of the hydraulic motor taken along line 3—3 of FIG. 1 showing a valve plate.

FIG. 3 is a transverse cross section of the compact motor taken along lines 3—3 of FIG. 1. The valve plate 48 and ports 56 are shown in detail in FIG. 3 by solid lines. Commutator ports 54 and 49 are shown in dotted lines. During motor operation the valve plate sequentially allows fluid from the commutator ports to enter the chambers formed between the rotating inner member 30 and non-rotating outer members 32.

Figure 2:
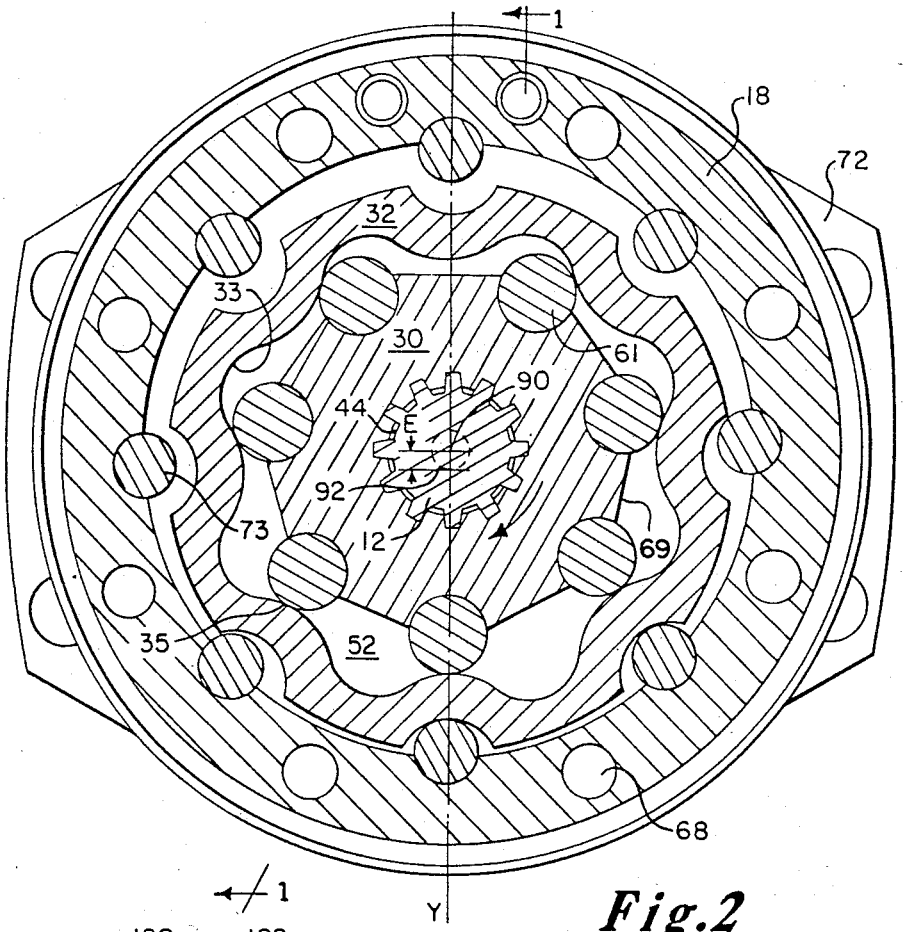
FIG. 2 is a cross section of the compact hydraulic motor taken along lines 2—2 of FIG. 1 showing an internal gear set.

The gear set is made up of inner gear 30 and outer gear 32 and is shown in detailed cross section in FIG. 2. The high pressure fluid from high pressure commutator ports 54 enters chambers 52 causing the chambers to expand and thereby rotate the central motor shaft 12. Fluid which has lost pressure by propelling the central shaft 12 remains in some of the chambers 52. This fluid is then removed from the motor chambers 52 through valve plate 48 which selectively opens passages from the contracting chambers to the low pressure commutator ports 49. These low pressure output commutator ports 49 alternate circumferentially with the higher pressure input ports 54. As shown in FIG. 1, these ports 49 are connected together with a gallery, or plenum 51.

The inner member 30, mounted upon shaft 12, comprises a plurality of circumferentially spaced semicircular gear teeth 61 (FIG. 2). In the embodiment of FIG. 2, the teeth consist of circular cylinders or rollers 61 which are held at a uniform radius from the center of rotation. The gear teeth are spaced equidistantly about the circumference of the inner member and are connected by flat portions 69. These flat portions are never active in that they do not contact outer member 32.

The outer member has a non-circular or generated inner surface 33 with teeth 35 numbering one greater (8) than the number of teeth (7) on the inner member. The internally generated outer member's inner profile has a continuously changing radius of curvature which forms a smooth bearing surface for the teeth 61 of the inner member.

The outer member 32 moves eccentrically within the housing 12 but is restricted from rotation around its axis 92. The center point of the outer member, axis 92, moves in a circular orbit about the axis or rotation 90 of the inner gear 30. The radius 'e' of the circle made by the outer gear's center in its movement defines the amount of the outer member's eccentric movement.

Rotational movement of the outer member 32 is restricted by rollers 73 mounted in housing 18. These rollers are trapped in the gear housing to restrict outer members rotation about the axis while allowing for it to move eccentrically or orbit about the fixed axis 90 of the inner gear member 30. The rollers 73 permit a slight periodic rotational movement of the outer member in order to reduce friction and prevent motor binding during operation.

The inner peripheral surface of the outer member, or internally generated member (IGR) 32, is precisely generated by a grinding or other shaping mechanism in a sinusoidal like shape. The inner peripheral surface so shaped has a continuously changing radius of curvature. This shaping of the outer member is for the purpose of utilizing the eccentric movement of the outer member to provide for continuous contact between the teeth of the inner member and the outer member's inner peripheral surface. The teeth of the inner members are maintained in contact during rotation with the outer members. In this manner, both the inner and the outer rotors create circumferentially spaced sealed chambers 52, of varying volume in response to the orbital movement of the outer member 32, and the rotation of the inner member 30. Each of the rollers, or rolls, 61 is disposed at the appropriate radius with respect to the generated inner surface 33 of the outer member 32 to create the seven hydraulically sealed chambers 52. The smooth generated surface 33 is a low friction working surface which allows for easy rotation of the inner members 30.

The valve plate 48 is fixedly attached to shaft 12 adjacent to inner members 30 as shown in FIGS. 1 and 3. The valve plate therefore rotates in conjunction with the inner members. Depending on the rotational position of the valve plate with respect to the stationary commutator ports 49, 54, the seven valve ports in the valve (shown in solid lines in FIG. 3) open passages from the gear set chambers 52 to the commutator at either high or low pressure ports.

Figure 4:
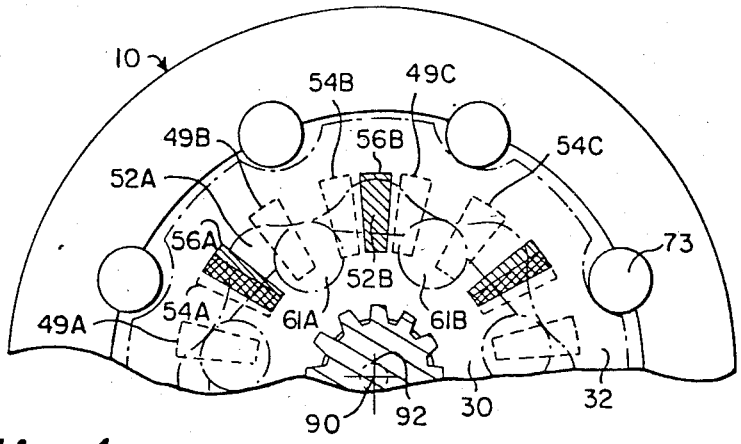
FIG. 4 is section of the hydraulic motor showing the working relationship of the gear set commutator and valve combination.
Figure 5:
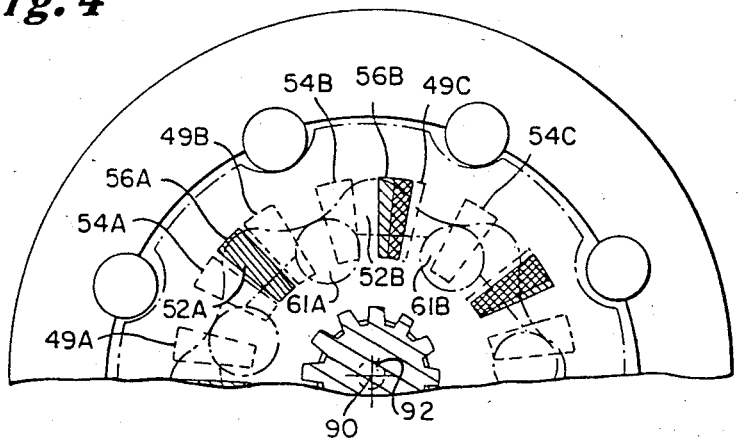
FIG. 5 is a partial section of the hydraulic motor shown in FIG. 4 after a slight clockwise rotation of the inner member.
Figure 6:
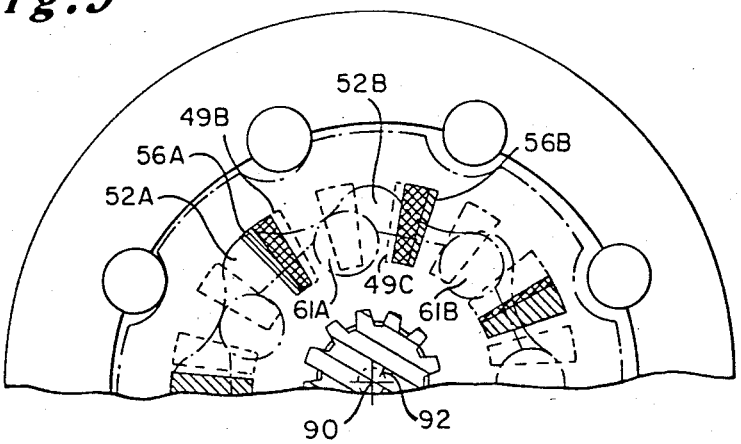
FIG. 6 is a partial section of the hydraulic motor shown in FIG. 5 after an additional slight clockwise rotation of the inner member.

FIGS. 4, 5 and 6 show the relationship of the gear set, the valve and the commutator as the motor operates. FIG. 4 is a cross section of the gear set and valve in which the motor is shown operating in a clockwise direction. The gear set is shown in phantom and the commutator ports in dotted lines. The valve ports are shown in solid lines with crosshatching. Chamber 52A is shown to be increasing in size and is being filled with high pressure fluid from commutator port 54A through valve port 56A. Chamber 52B is at its maximum volume and is not in communication with either commutator port 54B or 49C.

FIG. 5 shows the same elements as FIG. 4 after the motor has rotated a small fraction of a turn from the position shown in FIG. 6. The outer member's axis 92 has continued on its orbit about the inner member's axis 90. As a consequence, chamber 52A has reached a maximum dimension. Chamber 52A as shown is now sealed in out of fluid communication with the commutator due to the rotation of the valve port 56A. Chamber 52B has begun to decrease in size, and the valve plate allows lower pressure fluid to be withdrawn from the chamber 52B through valve ports 56B, by commutator port 49C.

FIG. 6 shows a further progression of the motor as chambers 52A and 52B both become smaller and have their low pressure fluid withdrawn through valve ports 56A and 56B.

In all cases when a maximum chamber size is reached in the movement of the inner and outer members, the valve plate 48 acts to open that chamber only to the low pressure commutator ports 49 until chamber volume reaches its minimum and the most low pressure fluid has departed, at which point the valving switches the connection back to high pressure only so that the chamber may refill to maximum size. High pressure and low pressure fluid is thereby intermittently fed and released from chambers 52 between the inner rotor 30 and the outer 32.

High pressure fluid entering into the gear set chambers pushes the teeth formed by rollers 61 towards the low pressure areas as the chambers 52 become larger in response to high pressure. This use of fluid pressure to supply rotational energy decreases the hydrostatic pressure of the fluid. Low pressure fluid is then withdrawn from between the outer and inner rotors back through the valve plate 48 which opens the passage to the low pressure commutator ports 49. To reverse rotation of the motor, high pressure and low pressure fluid may be reversed at the inlet and outlet, and the motor will work as efficiently in the opposite direction from that detailed above.

The seven valve ports 56, or field elements, on the valve plate 48 are activated eight times per revolution. This continual release of fluid pressure for rotational energy in each of the seven chambers 52 provides high torque for a small amount of rotation. Given a similar fluid input pressure, a traditional gerotor set with only two valve ports would spin at a much faster speed and lower torque than a motor valved as above. It is for this reason that the motor as a whole may be considered a high torque low speed motor.

The rotating valve plate permits a high level of fluid volume to pass in and out of the opening and closing chambers 52 of the gear set at a very rapid rate. Shallow depressions 80 (FIG. 3) on the surface of valve plate 48 permit fluid from the commutator 16 to be positioned between the commutator and the rotating valve plate. Each shallow depression 80 prevents chafing between the commutator 16 and the rotating valve plate 48 and aids in balancing the valve plate during its rotation. As with any rotating part, unbalance tends to cause eccentric movement and wear. Since the valve plate rotates with the centrally rotating inner gear and shaft 12, such eccentric movement is to be avoided.

It is thus shown that chambers 52 created by the reciprocal members of the gear set are driven into rotational movement by the injection of high pressure fluid and the withdrawal of low pressure fluid. The fluid energy is thereby used to produce shaft rotation and work. Since the inner gear rotates centrally, valving may be accomplished with a centrally located valve plate and commutator that need not accommodate any eccentricity of motion.

Figure 7:
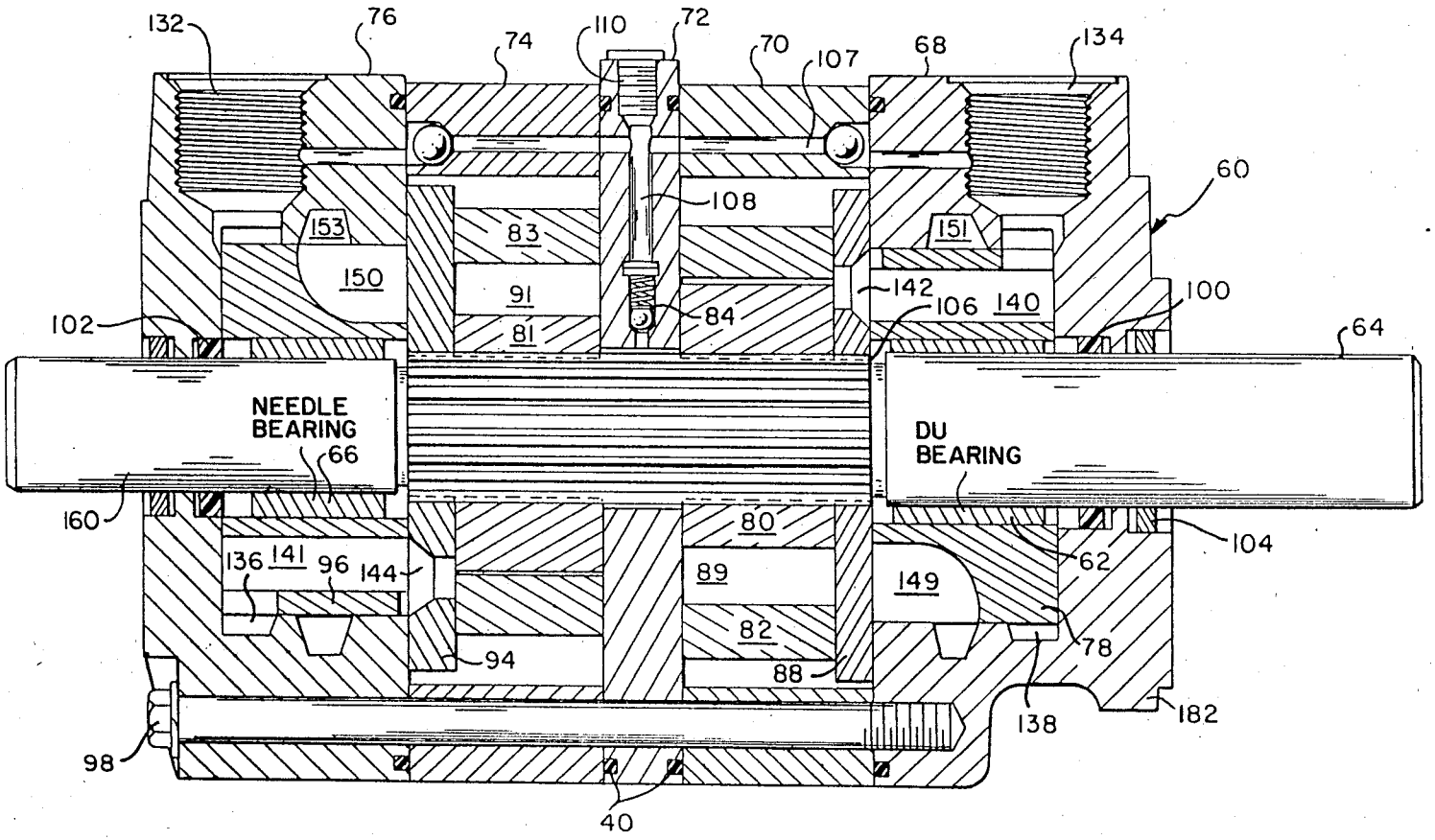
FIG. 7 is another embodiment of the invention, a dual speed high torque motor.

A dual displacement hydraulic motor 60 is shown in FIG. 7. The motor is a high torque low speed motor with two gear sets. The valve and commutator of one of the gear sets is configured much the same as those in the compact motor discussed above, and therefore the axial length of the entire dual speed motor is only slightly longer than a conventional high torque low speed motor as disclosed in copending U.S. patent application Ser. No. 394,648, filed July 2, 1982.

The dual speed motor is capable of providing the same torque or the same speed as a single displacement motor of equivalent type while utilizing only one half the flow. The two gear sets of the hydraulic motor may either be operated in series or parallel through the use of a manifold, or external hydraulic valve 112 shown schematically in FIG. 8. The motor thereby operates in either a high torque low speed mode or a high speed moderate torque mode.

The exchange flow in circuitry changes the operational characteristics of the dual speed motor in a manner which is advantageous for the various applications to which hydraulic motors may be put. When the motor elements are arranged to run in parallel, the motor produces the same torque as a single element equivalent type hydraulic motor but utilizes only one half as much fluid flow and runs at a reduced speed. During operation of the motor elements in series, the motor runs at the same speed as a single element motor of equivalent size but at decreased torque. In either mode the dual element motor only utilizes one half the flow of a single element motor and therefore only needs a supply pump with one half the flow capability of an equivalent single displacement motor.

The motor 60 embodying the invention as shown in axial cross section in FIG. 7 contains a sleeve bearing 62 and dual internal gear sets.

The motor 60 is enclosed in a multipiece motor housing in which a central shaft 64 is supported for rotation about a fixed longitudinal axis. The shaft 64 is held in position about its longitudinal axis by a sleeve bearing 62 at the output end and a needle bearing 66 at the aft end.

The motor housing is constructed in five separate pieces, output housing shaft 68, forward gear housing 70, pressurization valve housing 72, aft gear housing 74, and aft connector housing 76. These housings are positioned for ease of motor assembly and to allow access to internal parts.

The output shaft housing 68 contains a Teflon coated bearing known as a DU bearing 62 and a forward commutator 78. The motor shaft 64 extends out from the output shaft housing 68 and is used to power machinery. Mounting flange 182 formed in the housing 68 enables the motor to be affixed to a machinery frame and to transmit reaction forces generated during motor operation.

The forward gear housing 70 contains two gear members 80, 82 as well as valve plate 88. The pressurization valve casing 72 houses a pressurization valve 84 which serves to maintain an elevated pressure of hydraulic fluid in the bearings. The valve housing also serves to separate the two gear sets from each other.

Aft gear housing 74 contain two gear members 81 and 83 as well as the valve plate 94. The aft motor section operates in identically the same manner as the forward motor section.

Aft commutator housing supports the central shaft 64 through needle bearing 66. In addition, it includes commutator 96 which services valve plate 94 and rear gear set 81, 83.

Access to internal components is achieved by removal of bolts 98. Removal of bolts allows all components to be disassembled. Between each components are seals 40 which prevent hydraulic fluid leakage from the motor. Seal 100 prevents fluid leakage forward of sleeve bearing 62 and seal 102 prevents fluid leakage aft of needle bearing 66. The seals are maintained in position by a close tolerance fit and internal motor pressure during motor operation. Dust cover 104 prevents foreign matter from entering into the internal workings of the motor.

The output shaft housing 68 incorporates some of the same principles of the invention as discussed in regard to the single displacement motor 10. The output shaft housing 68 is substantially the same as housing 14 of FIG. 1. A DU bearing 62 is positioned about central shaft 64. Passage of hydraulic fluid is allowed through passages 106 from the valve 88 and gear set 80, 82. The passages are formed between the shaft spline and the roots of the rotating members. The sleeve bearing 62 is configured to draw hydraulic fluid into itself during operation of the motor. As configured herein, motor operation irrespective of speed will result in a bearing pressure of about 100 psi due to control valve 84 which maintains the fluid pressure in passages 106 in much the same fashion as the needle bearing of FIG. 1. Overpressurization of the seals is also prevented through the use of the pressurization valve 84. Fluid above a predetermined pressure will counter balance the spring and ball combination 84 and allow passage of fluid through passage 108 and out of the motor either through port 110 or a motor output port by way of passage 107. As noted before, use of the DU bearing allows for the positioning of commutator 78 at the correct diametric location to efficiently feed fluid through valve plate 88 to the gear set 80, 82.

Since commutator 78 may be efficiently positioned forward of gear set 80, 82, the motor is considerably shorter axially than would otherwise be the case. The commutator 78 occupies the same axial location as the forward bearing 62, and there is no increase in size of the forward housing 68 due to the commutator. Only the gear set housing 70 itself and the thin valve housing 72 extend motor length beyond that of a comparable single displacement motor.

Figure 8:
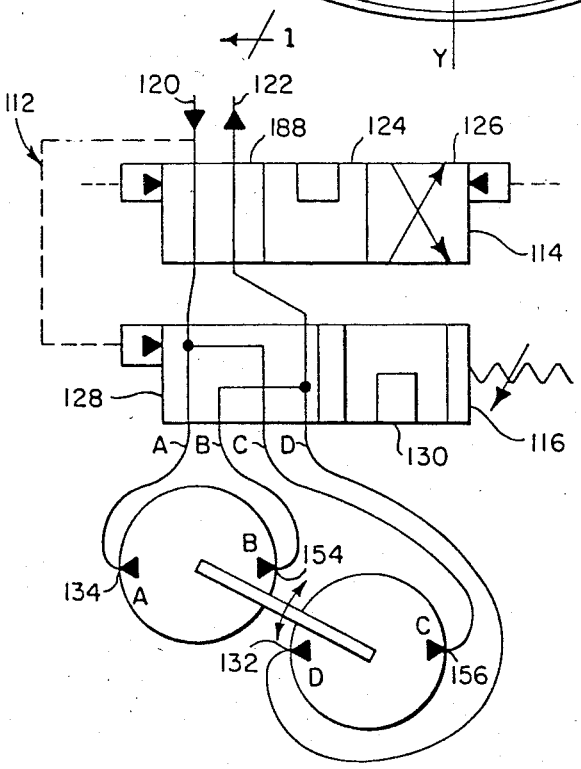
FIG. 8 is a schematic representation of an external control valve for the dual speed hydraulic motor.
Figure 9:
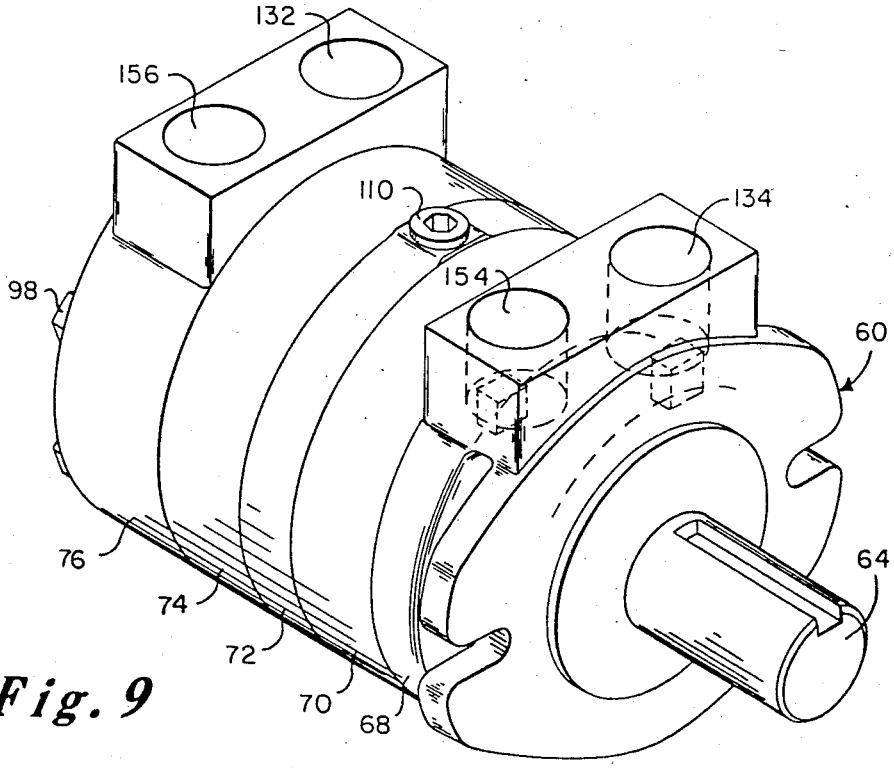
FIG. 9 is a perspective view of the dual speed hydraulic motor of FIG. 7.

FIG. 9 is a perspective view of the motor 60 of FIG. 7. FIG. 8 is a schematic of an external control valve for operating the motor shown in FIG. 7. FIG. 2 is a cross section of the previously discussed compact motor of FIG. 1. The internal gear sets used to propel the dual speed motor are identical to that used in the compact motor.

The path of the pressurized hydraulic fluid used in this device and the basic mode of operation of the device may be better understood with reference to FIGS. 2, 7, 8 and 9. The forward 80, 82 and aft 81, 83 gear sets of the dual speed hydraulic motor are identical to gear set 30, 32 (FIG. 2) of the single displacement motor 10. They may be operated either in series or parallel through the use of the hydraulic valve as schematically displayed in FIG. 8.

The hydraulic valve 112 is made up of two piston porting elements 114 and 116 which may be selectively positioned by hydraulic or electrical solenoid means.

Control valve element 114 permits the reversal of fluid flow as the valve is moved amongst three positions represented by the three boxes. When the valve element 114 is in position 118, the inlet flow 120 and outlet exhaust 122 flow directly into circuitry valve element 116. In the central position 124, inlet and outlet flow is short circuited and the motor is at rest since pressurized fluid flow bypasses the motor. Position 126 reverses the fluid flow of the inlet and the exhaust in order to reverse motor direction.

Circuit valve element 116 is a two-position valve 128, 130. Section 128 directs the flow to the inlet and outlet ports of the dual speed motor so that the motor gear sets will run in parallel. When the gear sets are run in parallel, fluid enters and leaves each gear set separately from the input and output streams 120 and 122. The motor fed in this manner runs at high torque and low speed.

Valve section 130 connects the input port of the aft gear set directly to the output port of the forward gear set so that the gear sets run in series. When running in series fluid from input line 120 flows through both gear sets in sequence before exiting through output line 122 and the motor operates at high speed, moderate torque.

The path of hydraulic fluid used in this device is discussed in detail below as shown in FIG. 8, where the two gear sets are running in parallel. The valving and operation of the gear sets is much the same as that described above in regard to the compact motor of FIG. 1.

High pressure fluid enters the hydraulic motor through inlet ports 132 and 134 (FIGS. 7 and 8). At the base of the inlet ports 132, 134 are inlet galleries 136, 138, which serve to conduct fluid to eight inlet commutator ports 140, in the forward commutator 78 and eight inlet ports 141 in the aft commutator 96. The inlet galleries or plenum 136, 138 are open annuli in the commutators connecting all the high pressure ports in each of the commutators and equalizing fluid pressure amongst them.

High pressure flows through the valve plates 88, 94 which are affixed to shaft 64 and rotate with it. Plates 88, 94 have a plurality of fluid transmission ports 142, 144. Valves plates 88 and 94 are identical to each other and valve plate 48 (FIG. 3) except that they are positioned within the motor to face their respective gear sets. During motor operation the valve plates sequentially allow fluid from the commutator ports to enter the chambers formed between the rotating inner member 80, 81 and non-rotating outer members 82, 83 in the same manner as the compact motor.

The forward gear set is made up of inner gear 80 and outer gear 82. The high pressure fluid entering chambers 89 causes the chambers to expand and thereby rotate the central motor shaft 64. Fluid which has lost pressure by propelling the central shaft 64 remains in some of the chambers 89. This fluid is then removed from the motor chambers 89 through valve plate 88 which selectively opens passages from the contracting chambers to the low pressure commutator ports 149. These low pressure output commutator ports 149 alternate circumferentially with the higher pressure input ports 140. As shown in FIG. 7, these ports 149 are connected together with a gallery, or plenum 151.

This same operation is simultaneously occurring in the rear gear set 81 and 83. Fluid leaving chambers 91 is expelled into commutator ports 150 which are connected by plenum 153. These annular plenums 151, 153 serve to equalize fluid pressure and conduct the fluid to outlet ports 154, 156 (FIGS. 8 and 9). In the forward end the motor fluid is expelled through outlet port 154 (FIG. 9). From these outlet ports fluid travels back through the control valve 112 to outlet stream 122.

The operation and details of the gear sets and valve are identical to that discussed above in relation to FIGS. 2–6 and the discussion will not be repeated. The combination of central rotation and compact valving produces the advantages which the dual speed motor possesses.

Central rotation of the inner gear allows for the use of a through shaft. Aft bearing 66 is a conventional needle bearing and therefore is of greater radial thickness than the pressurized sleeve bearing 62 in the output housing. Because of this, the shaft diameter is reduced to allow room for efficient positioning of commutator channels. Therefore, optional rear shaft 160 is not capable of supporting the same loads as the primary output shaft 64. This rear shaft may, however, be quite useful for a number of purposes. The rear shaft may be used for a speed pickup if one wishes to record hydraulic motor rpm or for mounting a brake. It is advantageous to mount a brake on a hydraulic motor on the same shaft as that used to drive machinery and yet not interrupt the drive path by interspacing the brake between the machinery and the motor. Use of the rear shaft 160 allows for this. The advantages of putting a brake on a through shaft motor are considered in detail in copending U.S. patent application Ser. No. 438,419, filed Nov. 1, 1982, now abandoned.

This dual speed motor 60 has advantages in many applications. The dual speed motor can provide either high torque low speed or high speed reduced torque with an invariant flow. The flow required is only one-half of the flow of an identical single displacement motor due to the capability of the dual speed motor when run in series to produce the high speed of a single displacement type motor at a lower torque, and when run in parallel to produce the same high torque as the single displacement motor at a lower speed. The dual gear sets either recycles or splits the fluid flow to achieve these operating characteristics.

The dual speed motor dispenses with the need for variable flow pumps and/or expensive transmissions which are required to vary torque and speed with a single displacement motor. These advantages may be extended to a multitude of similar applications and thereby add flexibility to inexpensive hydraulic motor systems.

Both FIGS. 1 and 9 disclose two compact hydraulic motors incorporating the principles of this invention. Both motors employ Teflon coated sleeve bearings in place of conventional needle bearings at their output ends. In the past, valving has been done on the tail end, or aft section, of the motor because of space problems in efficiently supplying fluid to the hydraulic compartments of the motor and the necessity of most gerotor type rotary motors to employ a "dogbone" coupling between the output shaft and the valve.

The improvement described herein incorporating the teflon coated sleeve bearing commonly called the DU bearing permits efficient valving at the output end of the motor. In order to use a DU bearing in this type of hydraulic motor and still have acceptable bearing life and motor load capability, the DU bearing utilized here is pressurized during motor operation.

It is important to note a few of the unifying concepts of the two embodiments of the invention. A primary reason that valving was not acceptable at the motor output end in the past was because of the diametrical thickness of the bearings required to support the shaft 12 (FIG. 1) under load. Typically, roller or needle bearings were used at the motor output end. The increase in radius from the center line due to thickness of the bearings did leave adequate room for the fluid passages of a high torque low speed motor commutator such as discussed above.

The options for one designing a hydraulic motor in the conventional fashion was either to move the commutator to the rear of the motor or thin the shaft 12 to allow the use of a smaller diameter bearing. A further option would be to move the bearing farther from the motor gear set to allow for placement of the commutator between the bearing and the gears 30, 32 (FIG. 1). None of these options are in fact efficient or economical ways to construct a hydraulic motor.

Firstly, if the shaft is thinned to allow for a small diameter bearing, shaft strength and motor capacity is improperly matched due to the weakness of the thin shaft section. Thus shaft breakage would be likely. Alternately, a greatly larger gear set and valve arrangement could be used but this is inefficient and they require a greater fluid flow.

If the bearing is removed a greater distance from the gear set 30 and 32 in the direction of the end of the output shaft 12, the bearing moment arm is increased. An increase in the moment arm means the bearings receive high stress loads both from the internal workings of the hydraulic motor and the machinery powered. This would result in a short bearing life and increased likelihood of motor failure.

The most viable solution has been to remove the commutator to the aft housing where the shaft may be thinned without affecting the stress capability of the motor since stress is absorbed between the motor gears and the output end of the shaft. This had been the conventional motor arrangement.

The pressurized Teflon coated sleeve bearing utilized for this invention facilitates the placement of the commutator at the output end of the motor. It has been found that a sleeve bearing of this type when operated in a hydraulic motor will tend to draw hydraulic oil into itself. These motors allow passage of this hydraulic fluid to the bearing to lubricate it.

In the single displacement motor, the full complement needle bearing is positioned to restrict flow and maintain sleeve bearing pressure. In the dual displacement motor, a separate pressure control valve is provided. Both arrangements maintain a positive fluid pressure in the sleeve bearing, which prevents bearing cavitation and damage that would otherwise occur during motor reversal or other rapid motor speed changes. The motors thereby avoid the cavitation problem that apparently caused sleeve bearing failure in the past and rendered the bearings unsuitable for the uses described herein.

Testing has shown that these bearings when pressurized in this manner are able to support surprisingly high radial loads in excess of 1,500 lbs. and have substantially longer operational life than would have been supposed under normal operating conditions. A maximum torque output in excess of 4,600 inch-lbs. at 2,000 psi supply pressures has been recorded.

The principles discussed above have been incorporated into the development of the two hydraulic motors shown in FIGS. 1 and 9. Both compact hydraulic motors have reduced axial length. This reduced length permits construction of this motor at reduced cost, size and weight. In many applications, reduced size and weight combine to greatly increase the efficiency of a powered device, particularly in transportation applications.

While the inventions have been particularly shown and described with reference to the preferred embodiments thereof, it will be understood by those skilled in the art that various changes in form and details may be made therein without departing from the spirit and scope of the inventions described in the appended claims. It is expected that compact forward end valving with a sleeve bearing arrangement will be a great advantage in many applications not herein discussed in detail.

I claim:

1. A motor for providing relatively high torque at relatively low speed at an output end of a shaft comprising:

a. a housing having an inlet and an outlet port for the entry and exit of fluid;

b. a shaft rotatable about a fixed axis having said output end extending from said housing;

c. first and second insert bearings for supporting said shaft, said first bearing located adjacent to said shaft's output end;

d. an inner toothed member mounted upon said shaft for central rotation about the longitudinal fixed axis of said shaft, said inner member being disposed between said bearings and wherein the outer radial diameter of said first bearing is substantially smaller than the root diameter of said inner member;

e. an outer toothed member mounted within said housing for eccentric nonrotational orbital movement with respect to said fixed axis, said outer member defining with said inner member a plurality of circumferentially spaced chambers, the volume of individual chambers varying with rotation of the inner member;

f. commutator means positioned coaxially and co-planar to said first bearing, to direct fluid from said inlet and outlet ports to the chambers formed by the inner and outer members; and g. rotatable valve means affixed to said shaft between said commutator means and said inner and outer members and rotatable with the shaft to control flow from the commutator to the chambers.

2. An hydraulic motor comprising:

a. a motor housing having an inlet and an outlet port for the entry and exit of fluid;

b. a relatively large diameter drive shaft rotatable about a fixed axis and extending through one side of said housing;

c. first and second insert type bearings for supporting said shaft, the first bearing being a relatively small radial diameter self-lubricating bearing located at an end of the shaft which extends through the housing;

d. an inner member mounted upon said shaft for central rotation about the longitudinal fixed axis of said shaft, said inner member being disposed between said bearings and having a plurality of outwardly extending gear teeth joined by connecting portions between each gear teeth;

e. an outer member mounted within said housing for eccentric nonrotational orbital movement with respect to said fixed axis, said outer member having a plurality of inwardly extending gear teeth defining with the gear teeth of said inner member a plurality of circumferentially spaced chambers, the volume of individual chambers varying with rotation of the inner member and wherein the connecting portion between the gear teeth of the inner member do not contact the outer member;

f. commutator means positioned coaxially around said first bearing and co-planar thereto, with commutator ports laterally aligned with said spaced chambers to direct fluid from said inlet and outlet ports to the chambers formed by the inner and outer members; and g. rotatable valve means disposed intermediate the inner member and the commutator and affixed to said shaft having valve ports extending between said chambers and said commutator ports to control flow from the commutator to the chambers and thereby cause rotation of the inner member.

* * * * *